US005142841A

United States Patent [19]

Cappi et al.

[11] Patent Number: 5,142,841

[45] Date of Patent: Sep. 1, 1992

[54] BAG OPENING DEVICE FOR AUTOMATICALLY OPENING PLASTIC BAGS IN SUPERMARKET CHECK-OUT COUNTERS INCORPORATING BAG DISPENSING MACHINES

[75] Inventors: Angelo Cappi, Modena; Renato Rimondi, Bologna, both of Italy

[73] Assignee: A.W.A.X. Progettazione E Ricerca S.r.l., Modena, Italy

[21] Appl. No.: 736,394

[22] Filed: Jul. 26, 1991

[30] Foreign Application Priority Data

Aug. 1, 1990 [IT] Italy ..... 21171 A/90

[51] Int. Cl.[5] ..... B65B 43/28

[52] U.S. Cl. ..... 53/384.1; 53/390; 53/570

[58] Field of Search ..... 53/384.1, 390, 381.1, 53/459, 468, 568, 567, 570, 385.1, 386.1

[56] References Cited

U.S. PATENT DOCUMENTS

| | | | |
|---|---|---|---|
| 3,564,814 | 2/1971 | Graveley | 53/384.1 X |
| 3,699,741 | 10/1972 | Norman | 53/385.1 X |
| 3,916,603 | 11/1975 | Kristiansen | 53/384.1 |
| 4,085,822 | 4/1978 | Osborn | 53/385.1 X |

FOREIGN PATENT DOCUMENTS

| | | |
|---|---|---|
| 0016691 | 3/1980 | European Pat. Off. . |
| 1294669 | 4/1962 | France . |
| 87-02001 | 3/1989 | Netherlands . |

*Primary Examiner*—James F. Coan

*Attorney, Agent, or Firm*—Cohen, Pontani, Lieberman & Pavane

[57] ABSTRACT

A bag opening device for supermarket check-out counters incorporating plastic bag dispensing machines, comprising two slides capable of mutual approaching and departing motion along a horizontal rail in a symmetrical direction with respect to a central position where the plastic bag to be opened is located; on each slide (7,8) is mounted a pair of rollers (1, 1' and 2, 2') in contact with each other, said pair of rollers being operated by a motor-reducer (13, 13') so as to simultaneously rotate the rollers of one pair in an opposite direction compared with the rollers of the other pair, said pairs of rollers being apt to come in contact with the opposite sides of a plastic bag (12) for grasping the sides and then pulling the sides apart, and subsequently to rotate in the opposite direction for releasing the sides of the bag from the grip of the rollers.

5 Claims, 2 Drawing Sheets

BAG OPENING DEVICE FOR AUTOMATICALLY OPENING PLASTIC BAGS IN SUPERMARKET CHECK-OUT COUNTERS INCORPORATING BAG DISPENSING MACHINES

FIELD OF THE INVENTION

The present invention relates to supermarket check-out counters incorporating plastic bag dispensing machines and, more particularly, to a device for automatically opening said bags before they are filled.

BACKGROUND OF THE INVENTION

It is known that frequently in supermarkets devices are placed for dispensing plastic bags, having the object of helping the operators and/or the customers in inserting into said bags the items purchased at the supermarket. There are also known bag opening devices which are incorporated in the supermarket check-out counters. Devices of this kind are for example described in U.S. Pat. No. 4,085,822 and in U.K. Patent Appln. No. 2,055,084.

Moreover, there has been recently invented, and forms the object of the Italian Patent Appln. No. 22455 A/89 of the same Applicant, an integrated machine suitable to be incorporated in a supermarket check-out counter, which automatically dispenses the plastic bags one at a time from a continuous strip of bags, opens them underneath a suitable mouth located on the counter upper surface, and ejects them after they have been filled.

All the above mentioned prior art apparatus and machines comprise a device for opening the plastic bags one at a time and for keeping them open as long as they are filled by the customer and/or the check-out operator. Such known devices, though very functional and reliable, are not without inconveniences, such as jamming, tearing of the bag edges and so on.

It is therefore an object of the present invention to provide a device free from these inconveniences, for automatically opening the bags and keeping them firmly in an open position as long as they are filled.

This object is attained by a device comprising two slides capable of mutual approaching and departing motion along an horizontal rail in a symmetrical direction as compared with a central position where the plastic bag is to be opened, wherein on each slide is mounted a pair of rollers, in contact with each other, operated by a motor-reducer in such a way to simultaneously rotate the rollers of a pair in the opposite direction compared with the rollers of the other pair, said pairs of rollers being able to contact the opposite sides of a plastic bag for grasping them and then pulling them apart, and subsequently to rotate them in an inverted direction for releasing them from grip.

The bag opening device according to the present invention has the advantage of having a very simple structure and therefore the maximum reliability. Another advantage of the bag opening device according to the present invention is of economic nature, due to its simple structure which requires reduced manufacturing costs.

BRIEF DESCRIPTION OF THE DRAWINGS

These and other advantages of the bag opening device according to the present invention will appear evident from the following detailed description of one embodiment thereof, with reference to the attached drawings in which.

DETAILED DESCRIPTION OF THE PRESENTLY PREFERRED EMBODIMENTS

Figure 1:
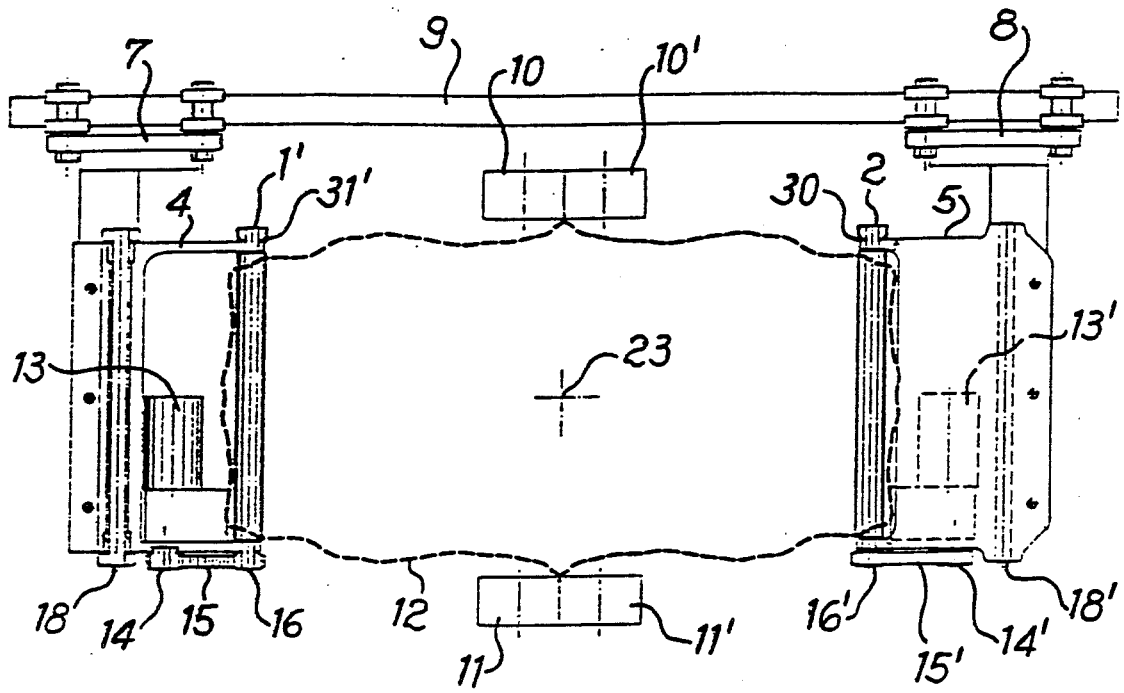
FIG. 1 shows a plan view of the bag opening device according to the present invention.

Referring to FIG. 1, the bag opening device according the present invention essentially comprises two pairs of rollers 1, 1' and 2, 2' mounted on two pairs of bearings 3, 4 and 5, 6 which are fixed onto slides 7 and 8 capable both of a mutual to-and-fro horizontal motion along rail 9 under the action of a motor-reducer (not shown). This bag opening device is mounted in the automatic filling machines immediately beneath the mouth through which are introduced the items to be inserted in the bags, as well as near the bag dispensing device, which is inside said machines. A portion of the bag dispensing device is shown as the pairs of feeding belts 10, 10' and 11, 11'.

In FIG. 1 is illustrated with broken lines a bag 12 which has been carried to that point by the pairs of feeding belts 10, 10' and 11, 11' which still hold two edges of bag 12. Bag 12 is illustrated in the open position reached after its two opposites sides have been pulled apart by the pairs of rollers 1, 1' and 2, 2'. At the beginning, said rollers were at the central position 23 in FIG. 1 and subsequently, after they had grasped the sides of bag 12, they have been moved away from said position by slides 7 and 8 which have mutually moved apart sliding along rail 9 under the action of the motor-reducer.

The to-and-fro motion of slides 7 and 8 along rail 9 is coordinated so that they progressively and concurrently approach each other or progressively and concurrently depart or separate from each other. The position of maximum mutual distance of slides 7 and 8 roughly corresponds to that illustrated in FIG. 1, that is, so that bag 12 is completely open and ready to be filled.

In FIG. 1 is shown only one roller of each pair, i.e. the lower roller 1' of the left pair and the upper roller 2 of the right pair. Lower roller 1' is borne at its ends by the arms of bearing 4 which is shaped as a fork to leave some room for mounting the small motor-reducer 13. The shaft 14 of motor-reducer 13 is connected by means of belt 15 to the axis 16 of roller 1'. By means of this arrangement roller 1' can be rotated by operating motor-reducer 13.

Of the other roller of the left pair, i.e. roller 1 which is not shown in FIG. 1, is visible only pin 18 by means of which its bearing 3 is pivoted on slide 7. Lever bearing 3 of roller 1 has the same shape and structure of lever bearing 5 of roller 2 of the right pair. It is made by a solid piece and therefore it hides the small motor-reducer 13', illustrated in FIG. 1 with broken lines. Under bearing 5 is located bearing 6 which holds roller 2' of the right pair and has the same fork shape of bearing 4 which holds lower roller 1' of the left pair. The external surfaces of every roller are rubberized to ensure a perfect adherence where they are in mutual contact, and a firm grip on the slippery plastic material, of which bags 12 are made, when said bags come in contact with the surfaces of the rollers.

Upper roller 1 of the left pair is permanently in contact with lower roller 1', so that, when the last mentioned roller is set into rotation by motor-reducer 13, it also causes the rotation, but in the opposite direction, of the upper roller, through the pair of gears 31, 31' mounted at the ends of rollers 1. Likewise, on the other side, the rotation of lower roller 2' controlled by motor-reducer 13' causes the rotation in the opposite direction of the upper roller 2 by means of the pair of gears 30, 30' mounted at the ends of rollers 2. Motor-reducers 13 and 13' are synchronized so that when motor-reducer 13 rotates roller 1' in one direction, motor-reducer 13' rotates roller 2' in the opposite direction.

Figure 2:
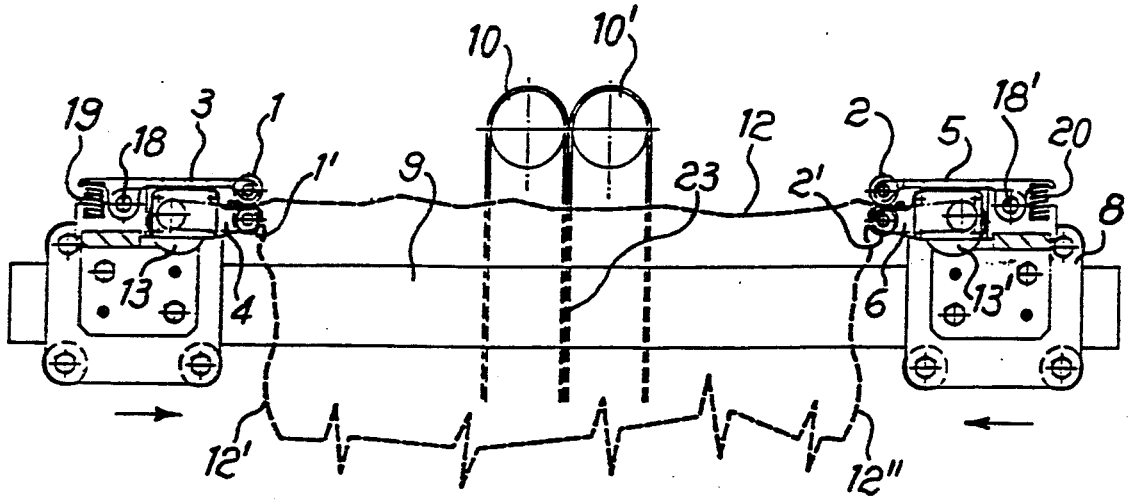
FIG. 2 shows a side elevational view of the same device.

In FIG. 2, which shows a side elevational view of the same device of FIG. 1 in an immediately subsequent operative step, are shown some structural elements of the device which were not visible in FIG. 1. These are upper roller 1 of the left pair with its lever bearing 3 and lower roller 2' of the right pair with its bearing 6. In FIG. 2 are also visible compression springs 19 and 20 which push one roller of each pair against the other. This arrangement ensures perfect adherence between the rubberized surfaces of rollers 1 and 1' and of rollers 2 and 2' which are intended to grasp, pull and hold the opposite sides 12' and 12'' of bag 12. In FIG. 2, bag 12 has reached its complete open position and its side-edges are not held any more between feeding belts 10, 10' and 11, 11' as illustrated in FIG. 1. In this position, bag 12 can be filled with items by letting them fall through the mouth of the machine, located immediately above said belts.

Once the bag has been filled, the bag is released from the grip of the two pairs of rubberized rollers and ejected from the machine. To release bag 12 from the grip of the two pairs of rollers it is sufficient to reverse the rotation control of motor-reducers 13 and 13' so that the two pairs of rollers 1, 1' and 2, 2' are rotated in a reverse direction with the consequence that they no longer pull on sides 12' and 12'' of the bag, and instead, by rotating in the opposite direction eject the sides of the bag held until the rubberized surfaces of the rollers of each pair contact one another.

At the same time the motor-reducer, which controls the motion of slides 7 and 8, sets these again in motion in the direction indicated by two arrows, so that the mutual approaching motion of both slides 7 and 8 along rail 9 is started until that the two pairs of rollers 1, 1' and 2, 2' are led to position 13 where they come in contact with a new bag 12 fed by conveyor belts 10, 10' and 11, 11'.

Figure 3:
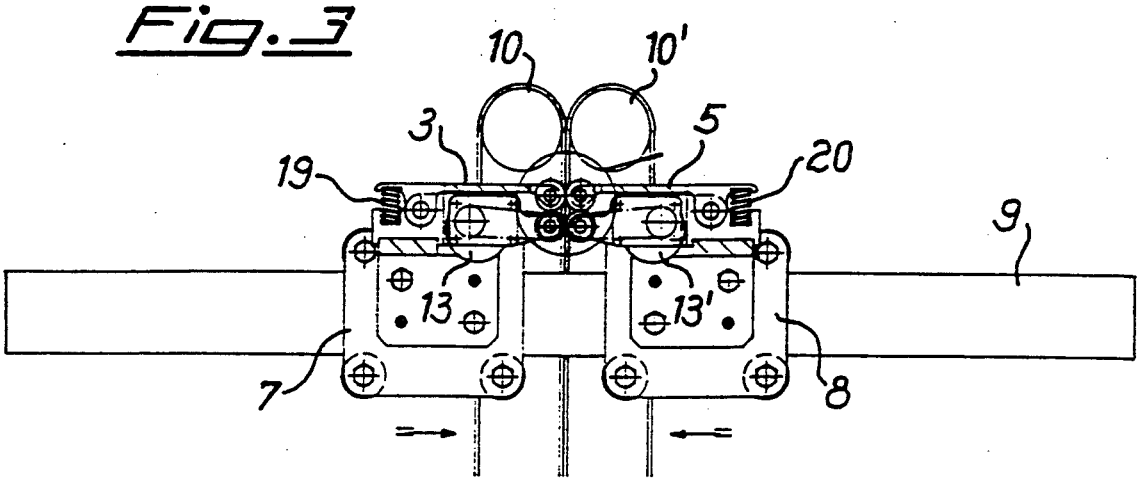
FIG. 3 shows an other side elevational view of the device of FIG. 2 during a different operative step.

In FIG. 3, slides 7 and 8 at the end of their mutual approaching motion along rail 9 are about to bring the two pairs of rollers 1, 1' and 2, 2' in contact with the sides of a bag 12 (not shown) fed by conveyor belts 10, 10' and 11, 11'. At this time the small motor-reducers 13, 13', appropriately controlled, operate rollers 1' and 2' by rotating them in an opposite direction in such a way that the rollers of each pair, which in turn motorize upper rollers 1 and 2 through the gears mounted at their ends, exert a pulling action on the plastic material of which bag 12 is made. This pulling action pulls and holds an edge of each side of bag 12 by each pair of rollers. When these pairs of rollers move away from each other, they pull the opposite sides of bag 12 causing it to open.

Figure 3A:
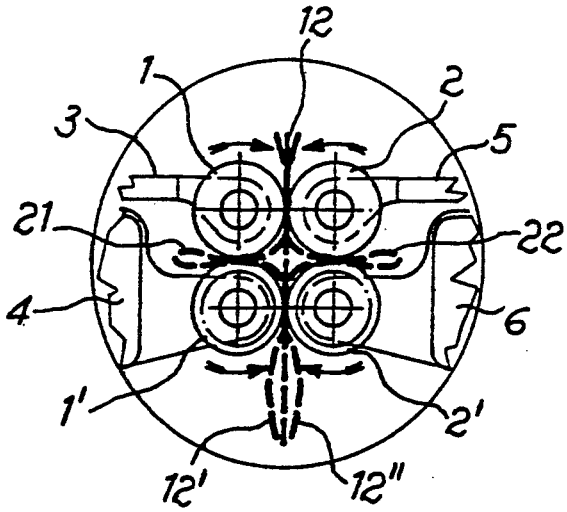
FIG. 3A shows an enlarged view of the area comprised within the circle in FIG. 3.

In FIG. 3A, which shows an enlarged view of the area comprised within the circle in FIG. 3, is illustrated in detail the way in which the pairs of rollers 1, 1' and 2, 2' are rotated for grasping and pulling the opposite sides 12' and 12'' of bag 12. Roller 1' is rotated counter-clockwise by motor-reducer 13 and therefore roller 1, through gears 31, 31', will rotate clockwise. The rubberized surfaces of rollers 1 and 1', by coming in contact with the plastic material of side 12', pulls an edge thereof causing the formation of a loop 21. Likewise, on the opposite side, roller 2' rotates clockwise, so that roller 2 rotates counter-clockwise and the combined action of both rollers causes the formation of a loop 22. These loops 21 and 22 may be considered as a kind of handle by means of which each pair of rollers can grasp and pull the opposite sides of bag 12. At this moment the main motor-reducer operates slides 7 and 8 causing their mutual departing motion and the consequent mutual departing motion of the two pairs of rollers. This action causes the separation of loop 21 from loop 22 and therefore the opening of bag 12. Then the operative steps illustrated in FIG. 1 and FIG. 2 are started again until a new working cycle as above described has been completed.

What is claimed is:

1. A device for opening a plastic bag in a supermarket check-out counter incorporating a plastic bag dispensing machine comprising:

a frame;

a horizontal rail (9) horizontally mounted on said frame;

two slides (7, 8) slidably mounted on said horizontal rail (9) and capable of symmetrically approaching and separating from one another with respect to a central position where the plastic bag (12) to be opened is located;

two pairs of rollers (1, 1' and 2, 2'), a pair of said pairs of rollers being mounted on each one of said two slides (7, 8), the rollers of each pair of rollers contacting one another; and a motor-reducer (13, 13') operatively connected to said pairs of rollers (1, 1' and 2, 2') so that said motor-reducer is capable of rotating the rollers of one of said pairs of rollers in one direction and simultaneously rotating the rollers of the other of said pairs of rollers in an opposite direction and so that when said pairs of rollers contact opposite sides of the plastic bag (12) said pairs of rollers upon rotation in a first direction grasp the sides of the plastic bag and then pull the sides of the plastic bag apart and when said pairs of rollers rotate in a second direction opposite to said first direction said rollers release the sides of the plastic bag.

2. Device according to claim 1, characterized in that the rollers of each pair of rollers (1, 1' and 2, 2') are respectively mounted on the slides (7, 8) by means of a pair of bearings (3, 4 and 5, 6) fixed onto the slides (7, 8).

3. Device according to claim 2, characterized in that the rollers of each pair of rollers (1, 1' and 2, 2') are kept in a tight mutual contact by a compression spring (19, 20) acting on the bearing (3, 5) of one roller of each pair (1, 2).

4. Device according to claim 1, characterized in that the rollers of each pair of rollers (1, 1' and 2, 2') are kept in a tight mutual contact by a compression spring (19, 20).

5. Device according to claim 1, 2, 3 or 4 characterized in that the external surface of the rollers of each pair (1, 1' and 2, 2') is rubberized.

* * * * *